US006914218B2

(12) United States Patent
Vernik et al.

(10) Patent No.: US 6,914,218 B2
(45) Date of Patent: Jul. 5, 2005

(54) VACUUM OVEN, SYSTEM INCORPORATING THE SAME AND METHOD OF USING THE SAME

(75) Inventors: Dmitry Vernik, Los Angeles, CA (US); Christopher B. Dreike, Torrance, CA (US); Terry D. Wolfson, Redondo Beach, CA (US)

(73) Assignee: Wems, Inc., Hawthorne, CA (US)

( * ) Notice: Subject to any disclaimer, the term of this patent is extended or adjusted under 35 U.S.C. 154(b) by 78 days.

(21) Appl. No.: 10/268,469

(22) Filed: Oct. 10, 2002

(65) Prior Publication Data

US 2003/0071029 A1 Apr. 17, 2003

Related U.S. Application Data

(60) Provisional application No. 60/329,190, filed on Oct. 12, 2001.

(51) Int. Cl.[7] ..... F27B 5/14

(52) U.S. Cl. ..... 219/390; 219/405; 219/411; 219/385; 392/416; 392/418; 118/724; 118/725; 118/50.1; 373/112; 373/137; 165/133

(58) Field of Search ..... 219/390, 385–387, 219/391, 394–395, 398, 402, 405, 407, 411; 392/416, 418, 435; 118/724, 725, 50.1; 373/112, 137; 165/133; 432/205

(56) References Cited

U.S. PATENT DOCUMENTS

| | | | | |
|---|---|---|---|---|
| 3,109,911 A | | 11/1963 | Kremer | |
| 3,260,783 A | * | 7/1966 | Shearer et al. | 373/112 |
| 3,686,476 A | * | 8/1972 | Schauer, Jr. | 219/413 |
| 4,167,983 A | * | 9/1979 | Seider et al. | 180/19.1 |
| 4,189,632 A | * | 2/1980 | Swanson et al. | 219/413 |
| 6,198,075 B1 | * | 3/2001 | Moffat | 219/390 |

FOREIGN PATENT DOCUMENTS

| | | |
|---|---|---|
| WO | WO 94/16278 | 7/1994 |

* cited by examiner

*Primary Examiner*—Shawntina Fuqua
(74) *Attorney, Agent, or Firm*—Christie, Parker & Hale, LLP

(57) ABSTRACT

A vacuum oven for decontaminating items, a system incorporating multiple such vacuum ovens and a method of operating such system are provided. The ovens are portable. They can have a vacuum drawn in them and can be heated by being coupled to a vacuum and a power source, respectively at a first location and then be decoupled from the vacuum and power sources and moved to a second location such as a glove box or clean room while still maintaining a vacuum.

59 Claims, 8 Drawing Sheets

VACUUM OVEN, SYSTEM INCORPORATING THE SAME AND METHOD OF USING THE SAME

CROSS-REFERENCE TO RELATED APPLICATION

This application is based and claims priority on Provisional Application Ser. No. 60/329,190, filed on Oct. 12, 2001, the contents of which are fully incorporated herein by reference.

BACKGROUND OF THE INVENTION

The present invention relates to a vacuum oven, to a system incorporating the same, and to a method of using the same, and more specifically to a vacuum oven that is portable and that can be moved while maintaining vacuum and to a modular system incorporating the same.

Chips and sensitive electronic components many times need to be worked on in an inert clean environment. To accomplish this, glove box/oven systems have been developed. Typically a glove box is a fully enclosed hermetically sealed box. An operator accesses the inside of the box through gloves attached to a side of the box.

An oven is attached to an end of the box. The interface between the oven and the box is also hermetically sealed to ensure an air tight seal. The oven can be opened at opposite ends. In this regard, the oven can be opened at its end attached to the glove box and at its opposite end.

Sensitive electronic equipment or items, as for example pacemakers, have to be sealed or welded in an inert environment. To accomplish this, the item is placed into the oven by opening the end of the oven not attached to the box. The oven is then closed and the item is heated under a predetermined vacuum i.e., it undergoes a vacuum bake cycle to get rid of moisture and impurities. Once the vacuum bake cycle is completed, the vacuum oven is back filled from the glove box and the end of the oven interfacing with the glove box is opened. The item is then moved into the glove box where the operator can work on it, as for example weld it.

The problem with current glove box/oven systems is that while the item is undergoing a vacuum bake cycle, other items cannot be brought into the glove box for processing. As such, use of the glove box is dependent on whether or not the oven is being used. Consequently, in a manufacturing setting, multiple glove box/oven systems are required to increase productivity. As a result, the manufacturing costs of the products processed through such glove box/oven systems are increased.

As such, an oven and a system are required that will allow the vacuum bake of items in locations away from the glove box or other clean air space and which can then be transported while maintaining vacuum into the glove box. In this regard, multiple items may be baked in one or more ovens and can be operated on using a single glove box or a single clean air space.

SUMMARY OF THE INVENTION

A vacuum oven for decontaminating items, a system incorporation multiple such vacuum ovens and a method of operating such system are provided. The ovens are portable. They can have a vacuum drawn in them and can be heated by being coupled to a vacuum and a power source, respectively at a first location and then be decoupled from the vacuum and power sources and moved to a second location such as a glove box or clean room while still maintaining a vacuum.

An exemplary embodiment oven includes a hollow body having an opening providing access to an interior of the body and at least one removable shelf fitted in the body. A heater such as a heating pad is coupled to the shelf. A power interface is coupled to the heater and is releasably coupled to an external power source separate from the body. A vacuum valve is coupled to the body and releasably couples to an external vacuum source. A door is coupled to the body for covering the opening and sealing against the body by vacuum. The exemplary embodiment oven can be incorporated in a system.

An exemplary embodiment system includes a rack having at least a bay for receiving a vacuum oven in each bay. Each bay has a vacuum valve and a power interface mounted therein. The vacuum valve controls the vacuum being drawn from a vacuum source. A vacuum oven is slidably fitted in the bay and is releaseably coupled to the rack, the power interface and vacuum source.

An exemplary method for decontaminating items using the exemplary oven of the present invention includes placing the items to be decontaminated in the interior of the oven and coupling the oven to a vacuum source for drawing vacuum in the oven. The oven interior is heated heating the items to a predetermined temperature for decontaminating. The oven is then decoupled from the vacuum source and moved to a work area where the vacuum in the oven is released and the oven door is opened providing access to the decontaminated items.

An exemplary method for operating multiple ovens in an exemplary system of the present invention for decontaminating items includes providing a rack having a plurality of bays and coupling a vacuum source and a power source to the plurality of bays. A first vacuum oven having a first items to be decontaminated in it is mounted in a first bay and the vacuum source and power source are coupled to the first vacuum oven. A vacuum is drawn in the interior of the first oven to a predetermined vacuum level and the interior of the first vacuum oven is heated to a predetermined temperature for decontaminating the first set of items. A second vacuum oven having a second set of items to be decontaminated in it is mounted in a second bay and the vacuum source and power source are coupled to the second vacuum oven. A vacuum is drawn in the interior of the second vacuum oven to a predetermined vacuum level and the interior of the second vacuum oven is heated to a predetermined temperature, for decontaminating the second set of items. One or both vacuum ovens may be removed from its corresponding bay while maintaining a vacuum. The second vacuum oven may be mounted in the rack and operated before or after the vacuum and temperature in the first vacuum oven reach their predetermined level and temperature, respectively, or while the vacuum and temperature in the first vacuum oven is ramping up to the predetermined level and temperature, respectively.

DETAILED DESCRIPTION

Figure 1:
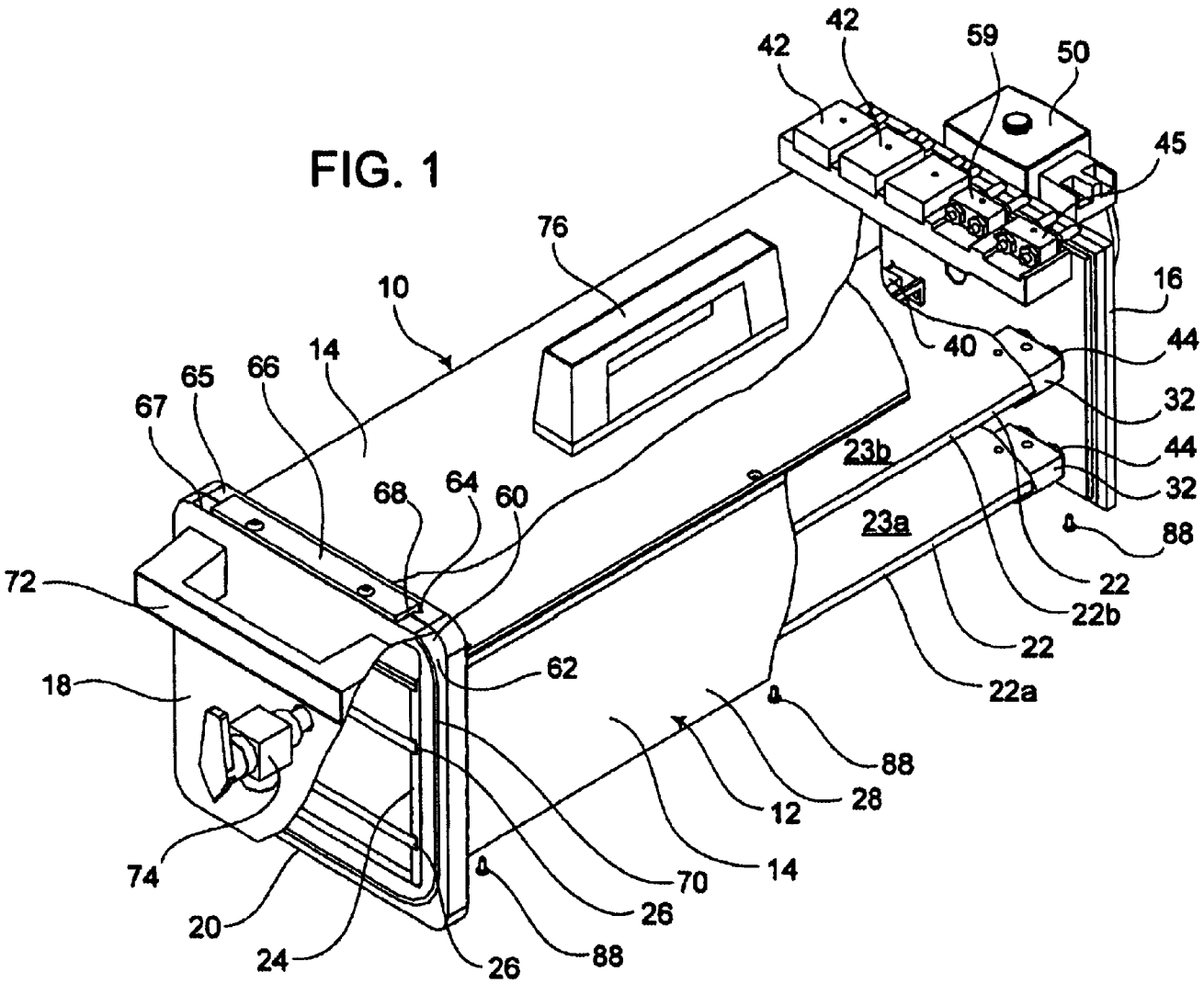
FIG. 1 is a perspective partial cut-away view of an exemplary oven of the present invention.

A vacuum oven, a system incorporating one or more of such ovens and a method of operating such ovens and system are provided. In an exemplary embodiment, an oven 10 of the present invention comprises a generally hollow elongated body 12 having four rectangular sides 14, one end wall 16 fixed to one end of the body and a door 18 at the other end 20 of the body for providing access to the interior of the body, as shown in FIG. 1. In an exemplary embodiment, the body 12 is extruded from aluminum. The end wall 16 is welded to the body. In alternate embodiments, the body may have other shapes, as for example, it may be a cylindrical. For descriptive purposes, however, the oven of the present invention is described herein in relation with an oven having a hollow body formed by four generally rectangular sides. The exemplary embodiment oven described herein is 6" wide, by 6" high by 18" long. Applicants have discovered that these dimensions provide optimum accommodations for most items typically treated by such ovens.

It should be noted that the terms "front," "rear," "top," "bottom," "upper," "lower," "uppermost," and "lowermost" are used herein for descriptive purposes to recite relative positions of various parts without limiting the location the parts to such positions.

The oven is designed to accommodate one or multiple shelves 22 which can be heated. In an exemplary embodiment, the shelves are formed from aluminum. To accommodate the shelves, two opposite side supports 24 are fitted in the oven, each having a slot 26 for accommodating each shelf 22. The slots are formed on the same location in each support. The supports are placed inside the oven against opposite sidewalls 28 of the oven 10, such that the slots are facing each other. In the exemplary embodiment, the oven supports are formed from Teflon® for allowing the shelves to slide easily along the slots on the supports. In addition, the oven supports provide thermal insulation to the oven, eliminating the need to insulate the oven from the outside for keeping the outer surface temperature of the oven at a safe level for handling. In an alternate exemplary embodiment, the slots may be formed on the inner surfaces of the sidewalls 28 thus not requiring the supports. In other exemplary embodiments, one or more shelves may be slidably fitted in the oven or may be fixed in the oven. For illustrative purposes, the exemplary oven is described as having three shelves, an upper shelf 22*c* which is fixed in place and two lower removable shelves which are slidably fitted in the oven. The upper shelf 22*c* is used for heating while intermediate shelf 22*b* and lower shelf 22*a* are used for heating and for supporting the items to be heated. Use of the upper shelf 22*c* allows for similar heating of space 23*b* between the upper shelf 22*c* and intermediate shelf 22*b* as of space 23*a* between the intermediate shelf and the lower shelf oven. Similar heating control is possible since both spaces 23*a* and 23*b* are bounded by two heating shelves.

Figure 3:
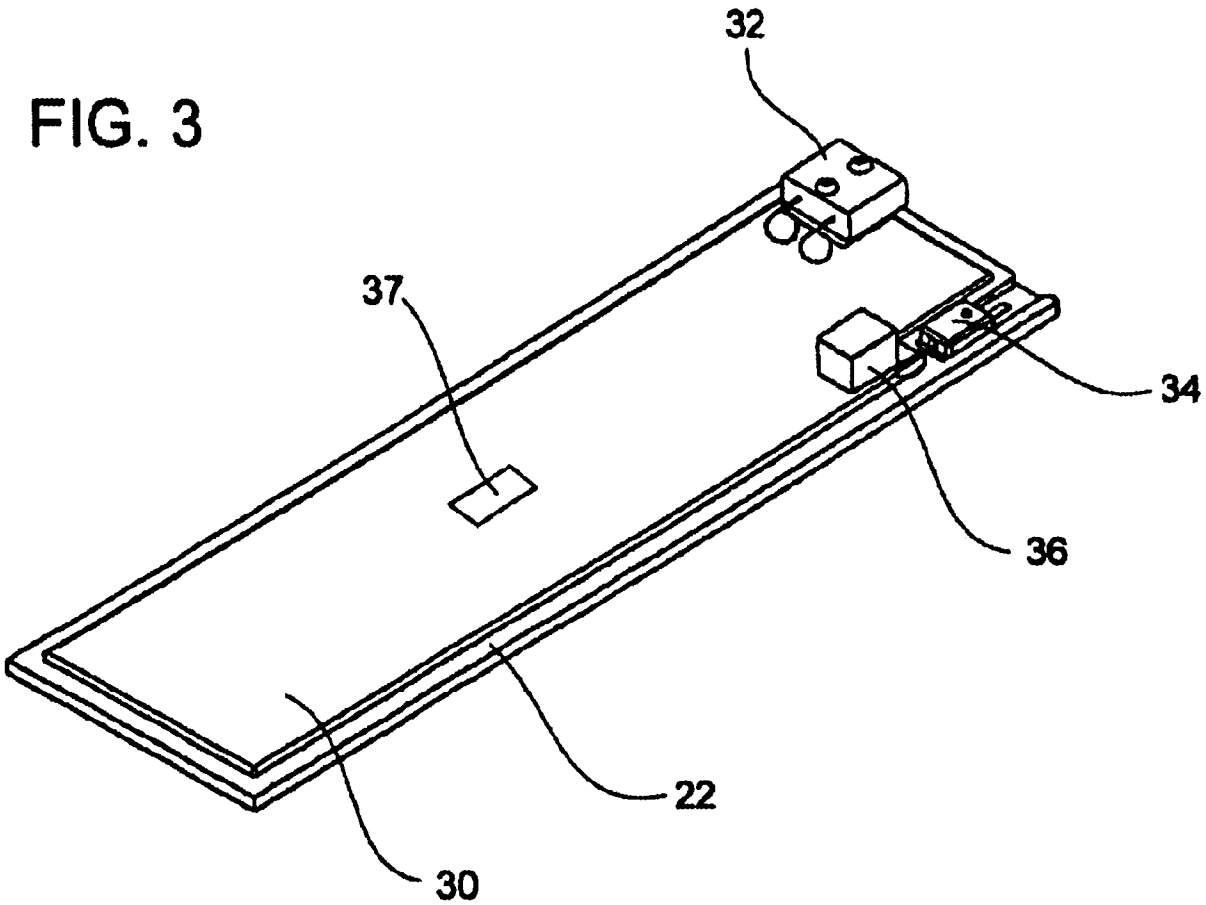
FIG. 3 is a perspective upside-down view of a shelf with heating pad for incorporation in the oven shown in FIG. 1.

In an exemplary embodiment, the shelves are heated by incorporating a heating pad 30 adhered to one side of each shelf as shown in FIG. 3. In other exemplary embodiments, other heaters such as heating elements may be used. In an exemplary embodiment, heating pads are used formed from silicon rubber. The heating pad of each shelf is connected to an interface assembly 32 which provides an interface for providing power for heating the heating pad and thus, the shelf. A thermocouple 37 is incorporated on the heating pad for measuring temperature. The thermocouple 37 is coupled to thermocouple plug 34 which provides an interface for the thermocouple 37. The heating pad includes an overtemperature thermostatic switch 36. The overtemperature thermostatic switch shuts off power to the heating pad when the temperature of the heating pad or heater exceeds a predetermined temperature.

In alternate exemplary embodiments, a heater such as a heating pad may be mounted on an upper inner surface of the oven such as the oven upper wall, thus not requiring a separate upper shelf just for heating.

Figure 2A:
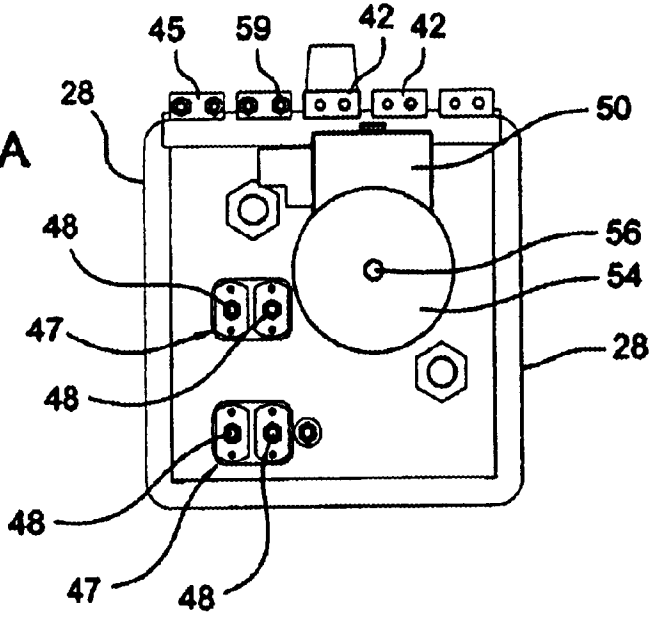
FIG. 2A is an end view of the exemplary oven shown in FIG. 1.
Figure 2B:
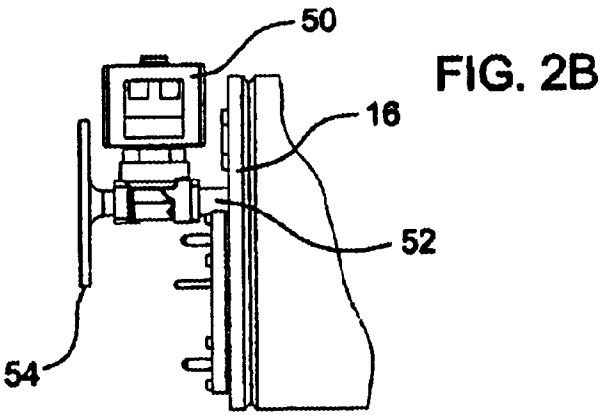
FIG. 2B is a partial end side view of the oven shown in FIG. 1.
Figure 2C:
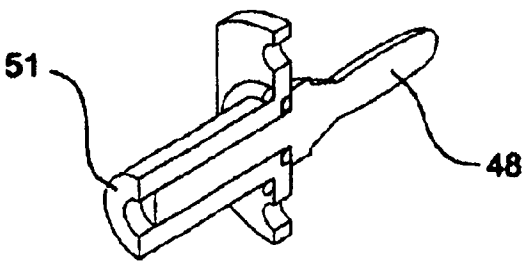
FIG. 2C is a perspective cut-away view of a pin with insulator sleeve assembly which extends from the rear wall of the oven shown in FIG. 1.
Figure 2D:
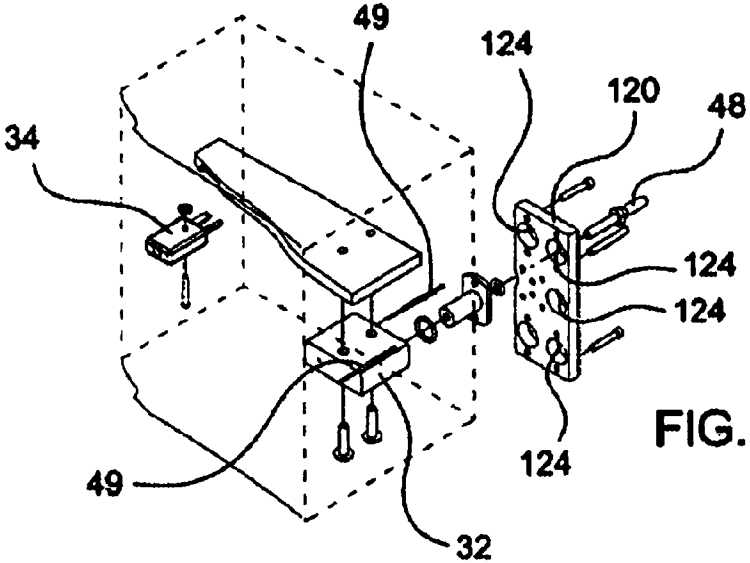
FIG. 2D is a partial end assembly view of the oven shown in FIG. 1 incorporating a keying system.

In an exemplary embodiment oven, when each of the intermediate and lower shelves is completely inserted into the oven along the slots 26 on the supports 24, each shelf's thermocouple plug 34 mates with a thermocouple interface 40. In the exemplary embodiment the thermocouple interface is a thermocouple heavy duty connector made by Omega Engineering, Inc. of Stamford, Conn. Each shelf thermocouple interface 40 is coupled to a thermocouple connector 42. In the exemplary embodiment shown in FIG. 1, the thermocouple connectors are external of the oven and are mounted on a rear top surface of the oven. Morever, in the exemplary embodiment, as each removable shelf is fitted into the oven, the interface assembly 32 of each shelf mates with a connector 47 which is coupled to openings 44 formed on the rear wall 16 of the oven. In the exemplary embodiment oven, each interface assembly 32 comprises two spring loaded conductive pins 49. Each connector 47 comprises two banana plugs 48 which penetrate openings 44 and interface with the conductive pins 49 (FIGS. 2A, 2C, 2D and 4A) when the shelves are pushed into position in the oven. The spring loaded pins provide for a reliable connection between the interface assembly of a shelf and the corresponding banana plugs of the connector 47. Preferably, the plugs 48 are surrounded by an insulating sleeve 51 as for example shown in FIG. 2C. The insulating sleeve fits into the openings 44 (FIG. 4A) formed on the rear wall of the oven sealing the openings air tight while allowing for penetration by the banana plugs. In an alternate embodiment, instead of banana plugs, the interface assembly may contain sockets that mate against the openings 44.

Figure 4A:
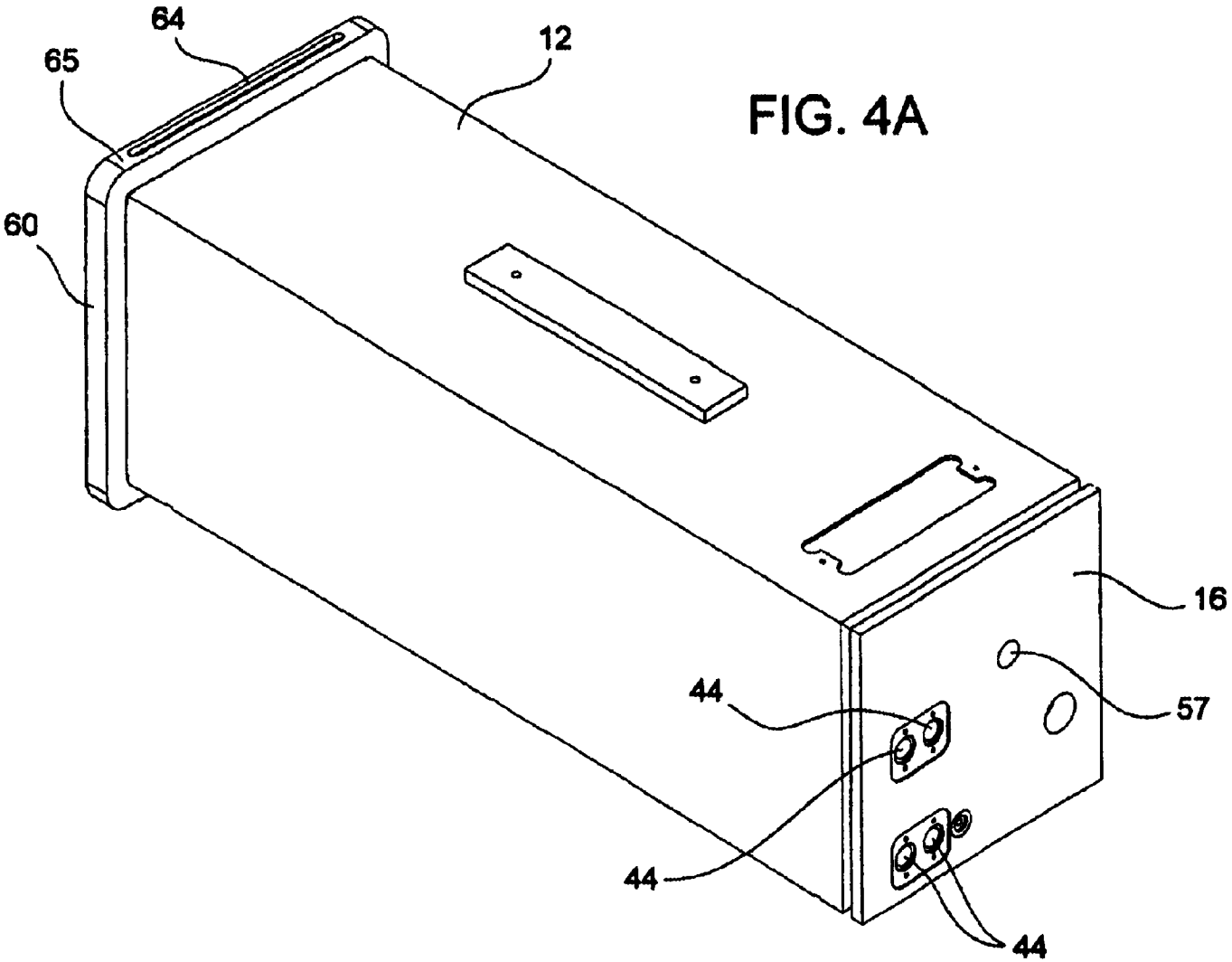
FIGS. 4A and 4B are perspective rear and front views, respectively, of the oven body with rear end wall of the oven shown in FIG. 1.

In the exemplary embodiment, the upper shelf 22*c* which is fixed to the oven is connected to connector 45. In an alternate exemplary embodiment instead of a connector 45, an interface assembly 32 is incorporated in the fixed shelf which is connected to a connector 47 as described in relation to the removable shelves. A two-way valve 50 is coupled to a fitting 52 coupled to the rear end wall 16 of the oven as for example shown in FIGS. 2A and 2B. A disc 54 is coupled to the end of the two-way valve 50 opposite the rear wall. An opening 56 is formed through the disc. The two-way valve 50 and fitting 52 provide access from the opening 56 formed through the disc to the interior of the oven through opening 57 formed on the rear wall 16 (FIG. 4A). The two-way valve controls the flow through the fitting. The two-way valve is preferably a solenoid type valve and is coupled to a connector 59 which in the exemplary embodiment is external of the oven as shown in FIG. 1.

Figure 4B:
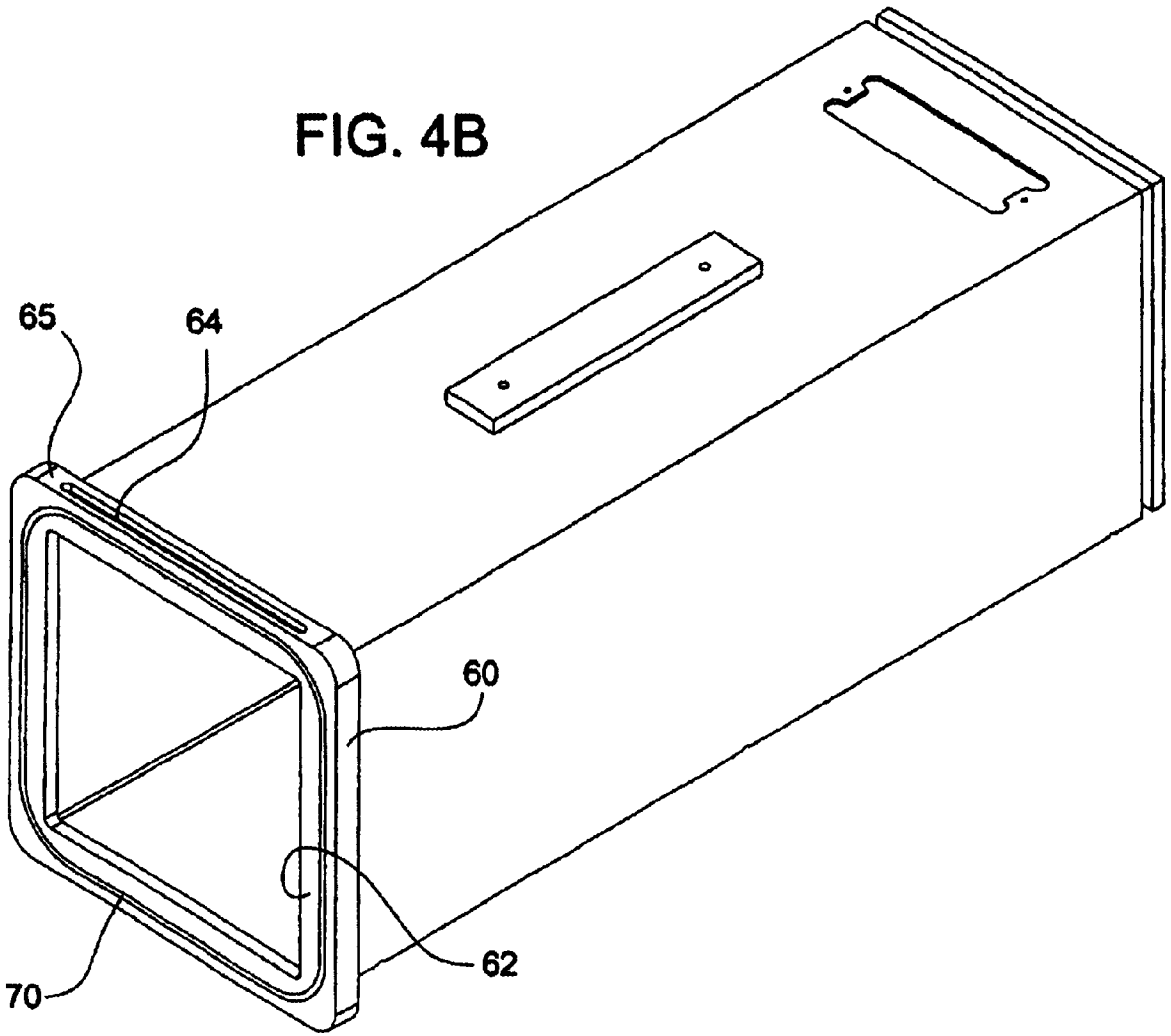

In the exemplary embodiment shown in FIG. 1, a lip 60 extends radially outward from the sides of the oven front end and surrounds the oven front end. The lip defines a flange surface 62 surrounding the front end of the oven. A groove 64 is formed on the upper surface 65 of the lip as shown in FIGS. 1, 4A and 4B. The door 18 has sufficient dimensions such that its entire surface proximate its perimeter mates with the flange surface of the lip.

A bracket 66 is attached or fastened to the upper end 67 of the door and has a lip portion 68 extending therefrom for mating with the groove 64 formed on the upper surface 65 of the lip as shown in FIG. 1. In this regard, the door can be hanged at the groove by using the bracket 66. In an alternate embodiment, the bracket may be integrally formed with the door. By hanging the door to the body, the door may easily be completely removed from the body so as to provide unimpeded access to the oven interior. In a further alternate exemplary embodiment, the door may be hingeably connected to the oven body.

To provide a seal between the door and the lip, in the exemplary embodiment, a groove 70 is formed on the flange surface of the lip extending around the entire perimeter of the oven end (FIGS. 1 and 4B). An O-ring seal (not shown) is fitted within the groove. In an alternate embodiment, the groove for accommodating the O-ring seal may be formed on the surface of the door mating with the flange surface of the lip.

In the exemplary embodiment, a handle 72 is formed on the door to allow for easy installation (i.e., hanging) and removal of the door from the oven. A valve 74 is also fitted through the door extending outward to relieve vacuum and provides access to the interior of the oven through the door.

A carrying handle 76 is coupled to the oven body and preferably an upper side of the body to facilitate the carrying the transportation of the oven.

Figure 5:
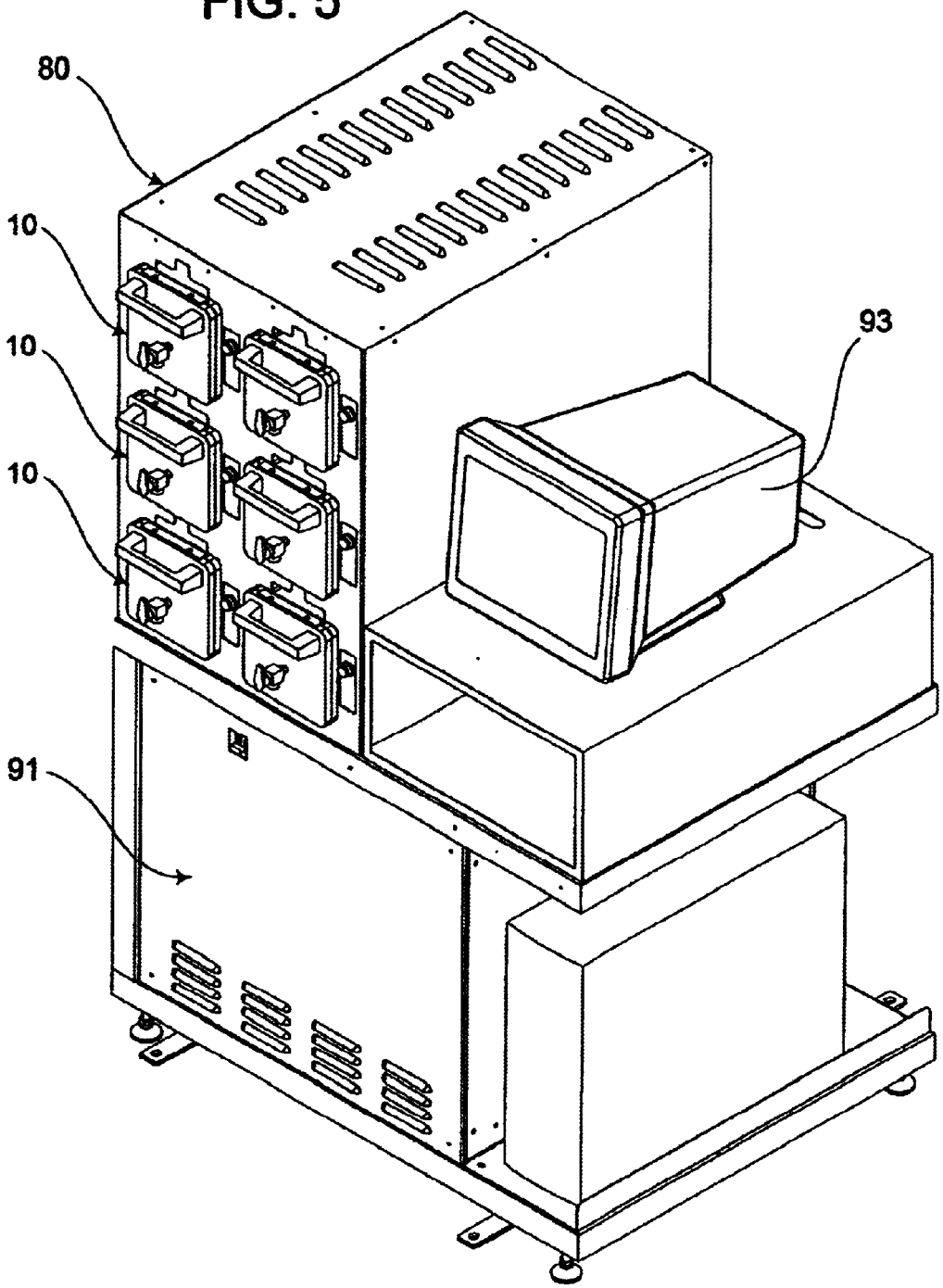
FIG. 5 is a perspective view of a system having a rack incorporating the oven shown in FIG. 1, a controller, and a computer.
Figure 6:
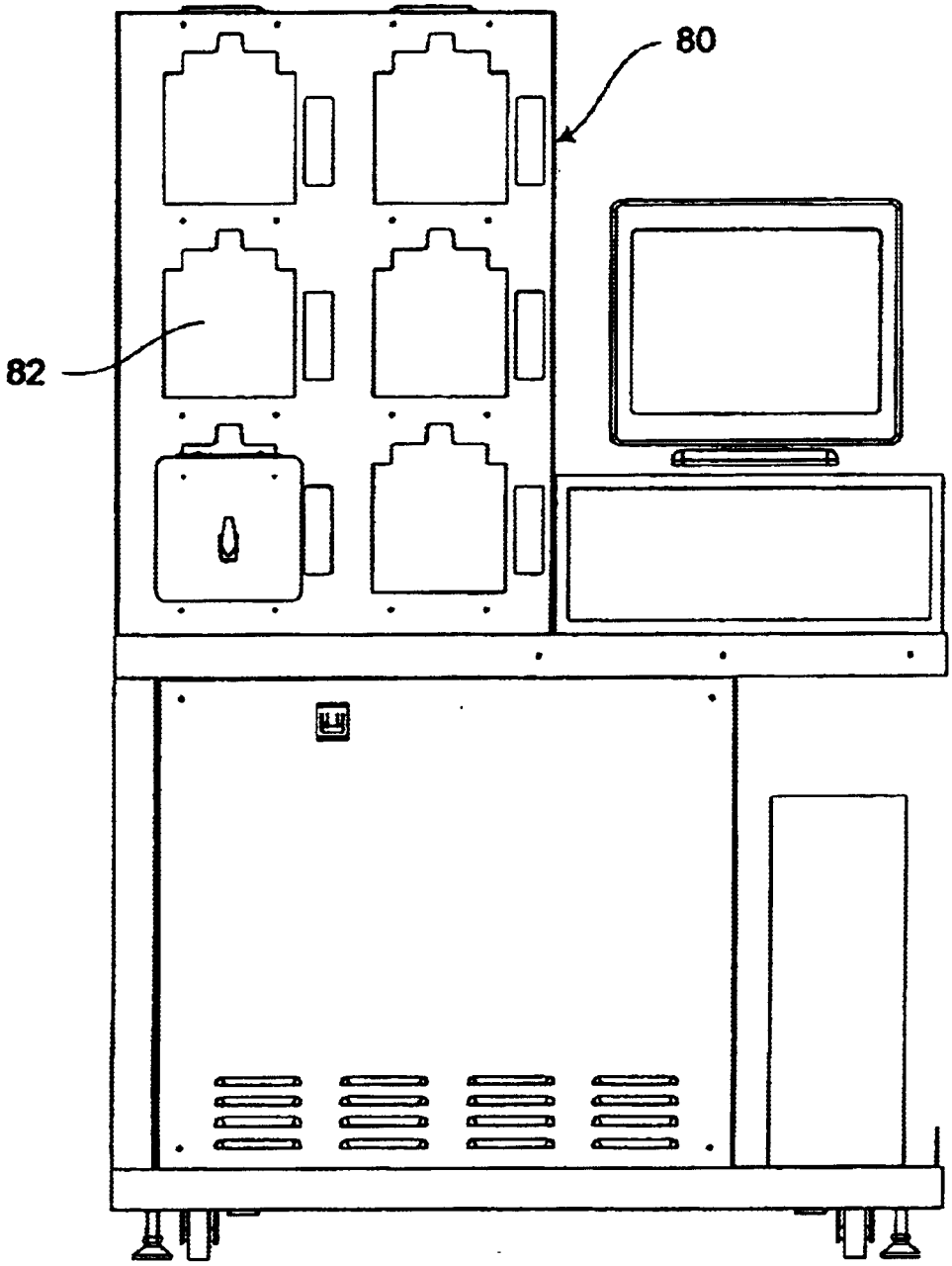
FIG. 6 is a front view of the system shown in FIG. 5.
Figure 7:
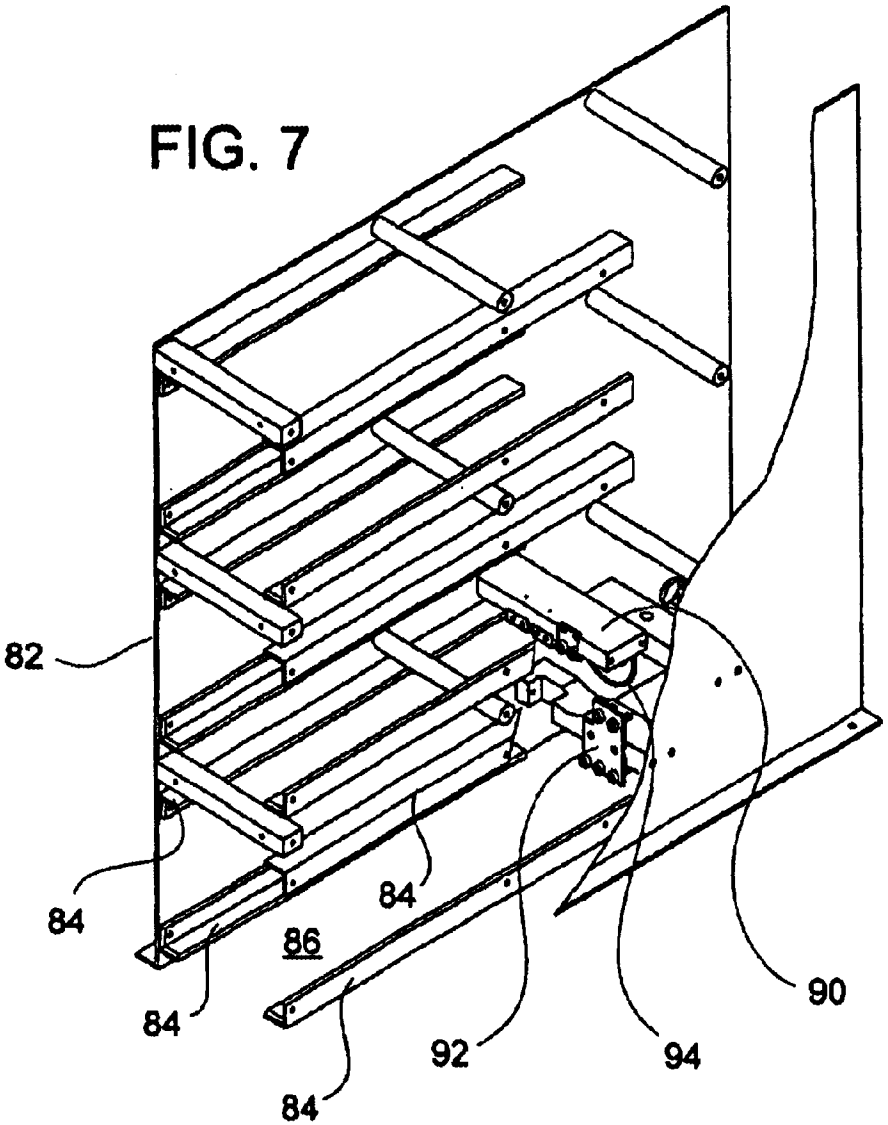
FIG. 7 is a partial cut-away perspective view of the rack shown in FIG. 5.

In an exemplary embodiment, the oven is mounted on a rack 80 as for example shown in FIG. 5. The rack may accommodate one or multiple ovens forming a system. For descriptive purposes, a rack that can accommodate six ovens is described herein. Each oven is slid into an opening 82 formed on the rack (FIG. 6). The rack comprises rails 84 which extend from each opening and define bays, as for example bays 86, to support the ovens (FIG. 7). Each rail defines a corner of a bay 86 into which the oven is slid for mounting. To reduce the friction between an oven and the rails when sliding, low coefficient of friction nylon feet 88 may be mounted on either side of the lower surface of the oven for interfacing with the two lower rails of a bay (FIG. 1). In an alternate exemplary embodiment, low friction members such as feet may be mounted on the racks. Alternatively, the racks may be made from a low friction material.

At its rear end, each bay includes appropriate connectors for connecting with the various connectors of the oven such as the thermocouple connectors, the connector 45, the two way valve connector and the interface assembly. In the exemplary embodiment, a connector 90 is located at the rear end of each bay for connecting with the thermocouple connectors 42, the two-way valve connector 59 and the connector 45. The connector 90 is connected to a controller 91 which is controlled by a processor such as a computer 93 (FIG. 5). The connector 90 provides paths for receiving temperature indicative signals from the thermocouples 37 of each shelf and provides paths for providing power to the two-way valve connector 59 for controlling the two-way valve 50 and to the heating pad of the upper shelf 22*c* for heating the upper shelf. A shelf connector 92 is also located on the rear of each bay to connect with the interface assemblies 32. The shelf connector 92 is also connected to the controller 91 and provides a path for providing power to the heating pad of each shelf via the interface assemblies 32. All of the connectors allow for quick connection and disconnection with their corresponding connectors and assemblies on the oven.

Figure 8:
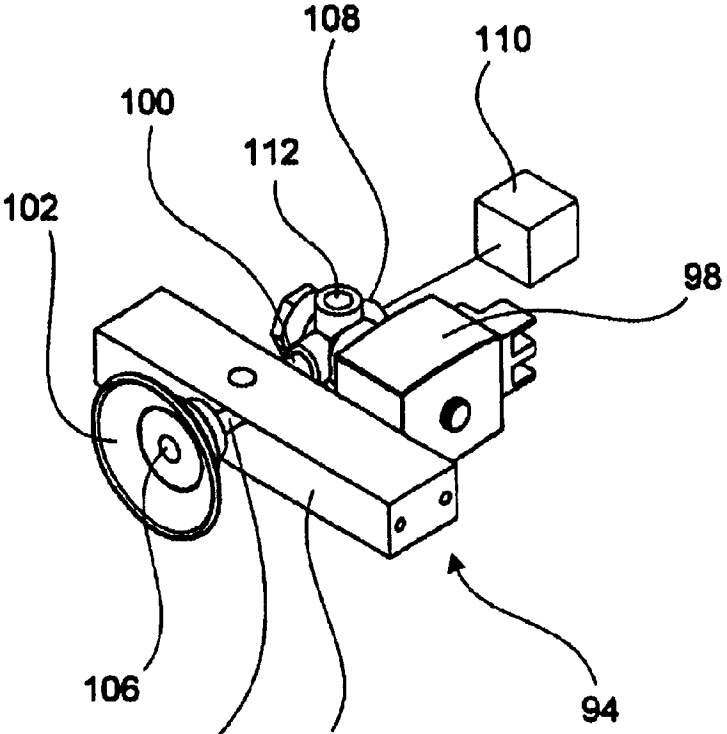
FIG. 8 is a perspective view of a manifold valve assembly incorporated in the rack shown in FIG. 7.

In the exemplary system, a manifold valve assembly 94 is also located on the end of each bay (FIGS. 7 and 8). An exemplary manifold valve assembly is shown in FIG. 8 and comprises a manifold 96. A three-way valve 98 is mounted on one end of the manifold via a fitting 100. A suction cup 102 is mounted on another end of the manifold via a fitting 104. A passage 106 provides a path from the suction cup to the three-way valve.

The suction cup is positioned on a bay to engage the disc 54 extending from the rear wall of an oven such that the passage 106 extending to the suction cup communicates with the opening 56 formed through the disc when the oven is mounted in the bay.

The three-way valve has a port 108 which is connected to a vacuum source 110 and a relief port 112 for relieving vacuum. The three-way valve may also be a solenoid valve and is also coupled to the controller 91. An exemplary three-way solenoid valve is manufactured by ASCO (Automatic Switch Co.).

Once the oven is mounted within its bay, the disc 56 mates with the suction cup 102 and a vacuum may be applied to the oven via the three-way and two-way valves. The two-way and three-way valves are controlled by the controller. The controller also individually controls the amount of power available to each of the interface assemblies for heating each of the shelves. The controller control of the valves and power may be manual through the use of the computer or may be automated. For example, the controller may be programmed to control temperature and vacuum ramp up and to maintain the temperature and vacuum in the oven at preselected levels. The temperature of each shelf is ascertained by the controller from signals received from the thermocouples and registered on the computer.

Once the oven is mounted on its appropriate bay and vacuum is applied, the vacuum pulls the door 18 tightly against the oven body 12 compressing the O-ring seal, fitted in the groove 70 on the flange surface, between the door and the flange surface, creating an air tight seal. Consequently, a latch is not required for keeping the door closed.

As the vacuum is applied, the suction cup engages and seals against the disc 54. Thus, to remove the oven without losing the vacuum in the oven, the two-way valve is closed while a vacuum is being drawn through the three-way valve. The three-way valve is then closed. Afterwards, the three-way valve relieves the vacuum in the manifold 96 through the relief port 112 so that the vacuum between the suction cup and disc is broken allowing for the withdrawal of the oven from the rack.

In an exemplary embodiment, all the ovens mounted into the rack are coupled to the same vacuum source. This alleviates the need to incorporate individual vacuum pumps and/or vacuum sources which are expensive. Consequently, the cost of the system is significantly reduced. Alternatively, multiple vacuum sources may be used.

Ovens may be installed into the rack at will and may be started at will. Each newly installed oven, however, may contain an atmosphere that may contaminate the other already installed ovens if they are not isolated when the newly installed oven is connected to the vacuum source. As such, it is necessary to use the three-way and the two-way valves to sequence the operation of the vacuum source to each of the ovens to avoid loss of vacuum in an evacuated oven.

In an exemplary operations sequence, the oven is mounted into the appropriate bay in the rack. The items to be decontaminated are placed on the oven shelves as appropriate, and the door is hung on the oven. The items may be placed in the oven prior to mounting or after mounting of the oven in the rack. The bay containing the new oven is selected on the computer. The selection may be made via the keyboard, mouse or touch screen. The operator then sends instructions via the computer to start the oven and may enter a data file name to identify the oven. If the other ovens have not finished the initial heat up and vacuum cycle, the system waits for the other ovens to reach their required temperature and vacuum. Then, the two-way valves on all the other ovens are closed and the three-way valve and then two-way valve on the newly installed oven are opened. Vacuum is spooled on the newly installed oven for a certain period of time and is checked to see if the vacuum level within a predetermined period of time has reached a desired level. For example, a typical value may be one millitor. If the vacuum does not reach the desired level, then an error is flagged and the process is stopped. If the vacuum does reach the desired level, then the two-way valve on the newly installed oven is closed.

The two-way valves on the other ovens which are in cycle mode (i.e. are being heated and evacuated) are opened, and heat is applied to the newly installed oven shelves until the temperature of the shelves reaches a desired level. The two-way valves are then closed on the other ovens. The two-way valve is then opened on the newly installed oven until the proper vacuum level is achieved. Once the proper vacuum level is achieved, the two-way valves on the other ovens are opened. When the bake cycle is completed on the newly installed oven, the two-way valve on the newly installed oven is closed and then the three-way valve is closed. This entire process may be automated through programming. An exemplary software that may be used to run the system is LABVIEW by National Instruments.

To remove the oven, the three-way valve opens the release port 112 so as to relieve the vacuum between the two-way valve and the three-way valve so as to allow the oven to slide out of the rack. The oven with the items may be then mated with or inserted in glove box, or it may be taken to a clean room where the vacuum oven is back filled with appropriate gas, e.g., the environment found in the glove box or clean room, and the door 18 is opened for removing the items treated by the oven. To back fill the vacuum oven so as to allow the door to open, the valve 74 coupled to the door is opened.

If it is desired that a specific oven is always mated with a specific bay in the rack, a key 120 (FIG. 2D) may be coupled to the rear of the oven that is accepted by a complementary key in a desired bay. For example, the key may have specific ports 124 arranged in a specific pattern that accommodate specific pins arranged in the same pattern and coupled to the rear and of the desired bay.

It should be noted that the exemplary oven, system and method have been described in relation to exemplary embodiments. It should be understood that the inventive oven, system and method are not limited to the exemplary embodiments. For example, other types of connectors and valves then those described may be used. For example, a female connector may be incorporated on the oven and a complementary male connector may be incorporated on the bay to connect with the female connector and vice versa. Moreover, the suction cup may be incorporated on the end of the fitting 52 extending from the oven instead of the disc 54 and the disc may incorporated at the end of the fitting 104 instead of the suction cup 102.

Although the present invention has been described and illustrated to respect the exemplary embodiments thereof, it is to be understood that it is not to be so limited, since changes and modifications may be made therein which are within the full intended scope of this invention as hereinafter claimed.

What is claimed is:

1. A vacuum oven comprising:

a hollow body having an opening providing access to an interior of said body;

a removable shelf fitted in the body;

a heater coupled to the shelf;

a power interface coupled to the heater and for releasably coupling to an external power source separate from the body;

a vacuum valve coupled to the body and for releasably coupling to an external vacuum source; and a door releasably coupled to the body for covering said opening, said door sealing against the body by vacuum, wherein said door is removable and separable from said body when a vacuum within the oven is released.

2. A vacuum oven as recited in claim 1 further comprising:

a thermocouple coupled to the shelf for measuring temperature; and a thermocouple interface coupled to the thermocouple and for releasably coupling to a controller.

3. A vacuum oven as recited in claim 2 further comprising an overtemperature switch controlling power from the power source to the heater when the temperature of the heater is greater than a predetermined temperature.

4. A vacuum oven as recited in claim 1 wherein the heater is heating pad.

5. A vacuum oven as recited in claim 1 wherein a bracket extends from the door and wherein the bracket seats on a groove formed on the body for hanging the door to the body.

6. A vacuum oven as recited in claim 1 further comprising a valve on the door for releasing vacuum from the oven allowing for removal of the door.

7. A vacuum oven as recited in claim 1 further comprising a handle mounted on the body for carrying the vacuum oven.

8. A vacuum oven as recited in claim 1 comprising at least two shelves slidably fitted in the body and a heater coupled to each shelf of said at least two shelves.

9. A vacuum oven system comprising:

a rack comprising a bay for receiving a vacuum oven;

a first vacuum valve mounted at the bay;

a first power interface mounted at the bay; and a vacuum oven slidably fitted in the bay and releasably coupled to the rack, the vacuum oven comprising, a hollow body having an opening providing access to an interior of said body, a first heater coupled to the body, and a second vacuum valve coupled to the body and in communication with an interior of the body, wherein when the vacuum oven is received in the bay, the first power interface releasably couples with the heater and the first vacuum valve is releasably coupled to the second vacuum valve in series.

10. A system as recited in claim 9 wherein the oven further comprises a door coupled to the body for covering the body opening, said door sealing against the body by vacuum.

11. A system as recited in claim 10 wherein a bracket extends from the door and wherein the bracket seats on a groove formed on the body releasably hanging the door on the body.

12. A system as recited in claim 9 wherein the vacuum oven further comprises a first thermocouple coupled to the body for measuring temperature.

13. A system as recited in claim 12 further comprising:

a power source coupled to the first power interface; and a vacuum source coupled to the first vacuum valve.

14. A system as recited in claim 13 further comprising a controller, wherein when the vacuum oven is received in the bay, the controller controls power provided by the power source and the operation of the first and second vacuum valves.

15. A system as recited in claim 14 wherein the controller receives signals from the thermocouple indicative of the temperature measured by the thermocouple, and wherein the controller controls the power provided by the power source in response to the signals it receives from the thermocouple.

16. A system as recited in claim 15 further comprising a processor for controlling and programming the controller.

17. A system as recited in claim 16 wherein the vacuum oven further comprises a second power interface coupled to the first heater, wherein then the vacuum oven is received in the bay, the first power interface releasably couples with the second power interface.

18. A system as recited in claim 17 wherein the vacuum oven further comprises a first shelf slidably fitted into the hollow body, and wherein the first heater and first thermocouple are mounted on the shelf.

19. A system as recited in claim 18 further comprising a first thermocouple interface mounted at the bay and to the controller, and a second thermocouple interface mounted on the vacuum oven, wherein when the vacuum oven is received in the bay, the first thermocouple interface releasably couples to the second thermocouple interface.

20. A system as recited in claim 19 wherein when the shelf is slidably fitted into the body, the thermocouple connects to the second thermocouple interface and the heater releasably couples to the second power interface.

21. A system as recited in claim 20 wherein the heater is a first heating pad.

22. A system as recited in claim 21 further comprising:

a second shelf slidably fitted into the vacuum oven body;

a second heating pad mounted on the second shelf and coupled to a third power interface; and a second thermocouple mounted on the second shelf and connected to a third thermocouple interface, wherein when the oven is received in the bay, the third power interface releasably couples with the first power interface and the third thermocouple interface releasably couples with the first thermocouple interface.

23. A system as recited in claim 22 wherein the second thermocouple interface and the third thermocouple interface are the same thermocouple interface.

24. A system as recited in claim 22 wherein the second power interface and the third power interface are the same power interface.

25. A system as recited in claim 22 further comprising:

a third shelf fixed to the vacuum oven body;

a third heating pad mounted on the third shelf and coupled to a fourth power interface; and a third thermocouple mounted on the third shelf and connected to a fourth thermocouple interface, wherein when the oven is received in the bay, the fourth thermocouple interface releasably couples with the first thermocouple interface.

26. A system as recited in claim 9 wherein the rack comprises a plurality of bays for receiving said vacuum oven.

27. A system as recited in claim 26 further comprising a plurality of vacuum ovens, wherein each of said plurality of vacuum ovens is received in one of said plurality of bays.

28. A system as recited in claim 27 wherein a separate vacuum valve is mounted on each of said plurality of bays and coupled to a controller and a separate power interface is mounted at each of said plurality of bays and coupled to a power source.

29. A system as recited in claim 28 wherein all the first vacuum valves are coupled to the same vacuum source.

30. A system as recited in claim 9 wherein the first vacuum valve is three way valve and the second vacuum valve is a two way valve.

31. A system as recited in claim 9 further comprising a first coupling member coupled to the first vacuum valve providing access to the first vacuum valve and wherein the vacuum oven further comprises a second coupling member extending from the second vacuum valve, wherein when the vacuum oven is slidably fitted in the bay the first coupling member mates with the second coupling member.

32. A system as recited in claim 31 wherein the first coupling member is a suction cup and the second coupling member is a disc.

33. A system as recited in claim 31 wherein the first coupling member is a disc and the second coupling member is a suction cup.

34. A system as recited in claim 9 further comprising a first key coupled to the oven and a second key complementary to the first key coupled to the bay, wherein when the oven is received by the bay, the first key mates with the second key.

35. A method for decontaminating items comprising:

placing the items in an oven interior;

coupling the oven to a vacuum source drawing a vacuum in the oven;

heating the items in the oven to a predetermined temperature for decontaminating;

decoupling the oven from the vacuum source;

moving the oven to a work area after decoupling; and releasing the vacuum after moving.

36. A method as recited in claim 35 wherein the oven comprises a door providing access to the oven interior, the method further comprising sealing the door against the oven by the drawn vacuum.

37. A method as recited in claim 36 further comprising a valve coupled to the door, wherein releasing the vacuum comprises opening said valve.

38. A method as recited in claim 35 wherein the work area is a glove box.

39. A method as recited in claim 35 wherein the work area is a clean room.

40. A method as recited in claim 35 wherein the step of releasing comprises backfilling the oven with a gas.

41. A method as recited in claim 35 wherein coupling the oven to a vacuum source comprises releasably coupling the oven to a rack and coupling the vacuum source to the rack.

42. A method as recited in claim 41 wherein heating comprises coupling a power source to a heater in the oven for providing power to the heater for heating the items.

43. A method as recited in claim 42 wherein heating comprises coupling a power source to a heating pad in the oven for providing power to the heating pad for heating the items.

44. A method as recited in claim 43 wherein coupling the power source comprises coupling the power source to the rack.

45. A method as recited in claim 44 wherein a first vacuum valve is mounted on the rack for controlling the vacuum from the vacuum source and wherein a second vacuum valve is mounted on the oven, wherein when the oven is releasably coupled to the rack the first and second valves are coupled in series and wherein drawing a vacuum comprises opening the first and second valves allowing the vacuum source to draw a vacuum in the oven, and wherein the second vacuum valve is closed and the first valve opens a port to relieve the vacuum when the oven is decoupled from the vacuum source.

46. A method for operating a plurality of vacuum ovens for decontaminating items:

providing a rack having a plurality of bays;

coupling a vacuum source to the plurality of bays;

coupling a power source to the plurality of bays;

mounting a first vacuum oven having an interior in a first of said plurality of bays;

releasably coupling the power source to the first vacuum oven for providing power f or heating the first vacuum oven;

releasably coupling the vacuum source to the first vacuum oven;

drawing a vacuum in the first vacuum oven to a first predetermined level;

heating the interior of the first vacuum oven to a first predetermined temperature;

mounting a second vacuum oven having an interior in a second of said plurality of bays;

releasably coupling the power source to the second vacuum oven for providing power for heating the second vacuum oven;

releasably coupling the vacuum source to the second vacuum oven;

drawing a vacuum in the second vacuum oven to a second predetermined level;

heating the interior of the second vacuum oven to a second predetermined temperature; and removing one of said first and second vacuums ovens from its corresponding bay while maintaining the vacuum within said removed oven.

47. A method as recited in claim 46 wherein each bay comprises a first vacuum valve coupled to the vacuum source for controlling vacuum drawn by the vacuum source and wherein each of said first and second vacuum ovens comprises a second vacuum valve wherein when a vacuum oven is mounted in a bay, one of said first vacuum valves couples in series with one of said second vacuum valves.

48. A method as recited in claim 47 wherein a processor is coupled to the rack for controlling the first and second vacuum valves and power supplied by the power source to each vacuum oven.

49. A method as recited in claim 48 wherein if the vacuum level in the first vacuum oven is not at the first predetermined level and if the temperature of the first vacuum oven is not at the first predetermined temperature when the second vacuum oven is mounted on the second bay, the method comprises:

waiting until the temperature and vacuum in the first vacuum oven reach the first predetermined level and first predetermined temperature, respectively;

closing the second vacuum valve coupled to the first vacuum oven;

opening the first vacuum valve on the second bay;

opening the second vacuum valve coupled on the second vacuum oven; and closing the second vacuum valve coupled to the second vacuum oven when the vacuum in the second vacuum oven reaches the second predetermined level.

50. A method as recited in claim 49 wherein if the vacuum in the second vacuum oven does not reach the second predetermined level within a predetermined period of time, the process is stopped.

51. A method as recited in claim 49 further comprising:

opening the second vacuum valve coupled to the first vacuum oven; and supplying power to the second vacuum oven for heating the second vacuum oven until the temperature inside the second vacuum oven reaches the second predetermined temperature;

closing the second vacuum valve coupled to the first vacuum oven;

opening the second vacuum valve coupled to the second vacuum oven allowing a vacuum to be drawn in the second vacuum oven; and opening the second vacuum valve coupled to the first vacuum oven when the vacuum in the second vacuum oven reaches the second predetermined level.

52. A method as recited in claim 51 further comprising:

closing the second vacuum valve coupled to the second vacuum oven when the temperature and vacuum in the second vacuum oven reach the second predetermined temperature and second predetermined level, respectively; and closing the first vacuum valve coupled to the second bay.

53. A method as recited in claim 52 wherein closing the second vacuum valve coupled to the second vacuum oven when the temperature and vacuum in the second vacuum oven reach the second predetermined temperature and second predetermined level, respectively comprises closing the second vacuum valve coupled to the second vacuum oven when the vacuum in the second vacuum oven reaches the second predetermined level while the temperature in the second vacuum oven reaches and is maintained at the second predetermined temperature for a predetermined time period.

54. A method as recited in claim 49 further comprising selecting the second oven from a list of ovens on the processor.

55. A method as recited in claim 47 wherein removing comprises, closing the second vacuum valve of the oven being removed and opening a port of the first vacuum valve coupled to the second vacuum valve of the oven being removed to vent the vacuum.

56. A method as recited in claim 46 wherein if the vacuum in the first vacuum oven does not reach the first predetermined level within a predetermined period of time, the process is stopped.

57. A vacuum oven comprising:

a hollow body having an opening providing access to an interior of said body;

a removable shelf fitted in the body;

a heater coupled to the shelf;

a power interface coupled to the heater and for releasably coupling to an external power source separate from the body;

a vacuum valve coupled to the body and for releasably coupling to an external vacuum source;

a door releasably coupled to the body for covering said opening, said door sealing against the body by vacuum; and a valve on the door for releasing vacuum from the oven allowing for removal of the door.

58. A vacuum oven comprising:

a hollow body having an opening providing access to an interior of said body;

a removable shelf fitted in the body;

a heater coupled to the shelf;

a power interface coupled to the heater and for releasably coupling to an external power source separate from the body;

a vacuum valve coupled to the body and for releasably coupling to an external vacuum source; and a door releasably coupled to the body for covering said opening, said door sealing against the body by vacuum, wherein a bracket extends from the door and wherein the bracket seats on a groove formed on the body for hanging the door to the body.

59. A vacuum oven as recited in claim 58 further comprising a valve on the door for releasing vacuum from the oven allowing for removal of the door.

* * * * *